US008215481B1

(12) United States Patent
Knickerbocker

(10) Patent No.: US 8,215,481 B1
(45) Date of Patent: Jul. 10, 2012

(54) CONTAINER CLOSURE FOR RETAINING AN ADDITIVE MATERIAL

(76) Inventor: Michael G. Knickerbocker, St. George, UT (US)

( * ) Notice: Subject to any disclaimer, the term of this patent is extended or adjusted under 35 U.S.C. 154(b) by 893 days.

(21) Appl. No.: 11/059,829

(22) Filed: Feb. 17, 2005

Related U.S. Application Data

(60) Provisional application No. 60/545,690, filed on Feb. 18, 2004.

(51) Int. Cl.
*B65D 25/08* (2006.01)

(52) U.S. Cl. ..... 206/222; 206/219; 215/DIG. 8

(58) Field of Classification Search ..... 206/219, 206/220, 222; 222/80; 215/10, DIG. 8
See application file for complete search history.

(56) References Cited

U.S. PATENT DOCUMENTS

| | | | | |
|---|---|---|---|---|
| 2,275,567 | A | 3/1942 | Smith | |
| 2,642,870 | A | 6/1953 | Smith | |
| 3,156,369 | A | 11/1964 | Bowes et al. | |
| 3,347,410 | A | 10/1967 | Schwartzman | |
| 3,968,872 | A | 7/1976 | Cavazza | |
| 4,550,825 | A | 11/1985 | Sutryn et al. | |
| 4,638,927 | A | 1/1987 | Morane | |
| 5,128,104 | A | 7/1992 | Murphy et al. | |
| 5,782,345 | A | 7/1998 | Guasch et al. | |
| 6,073,803 | A * | 6/2000 | Sturm et al. | 222/80 |
| 6,116,472 | A * | 9/2000 | Wanbaugh et al. | 222/340 |
| 6,148,996 | A * | 11/2000 | Morini | 206/222 |
| 6,149,866 | A * | 11/2000 | Luotola et al. | 422/58 |
| 6,230,884 | B1 | 5/2001 | Coory | |
| 6,387,073 | B1 * | 5/2002 | Weiler et al. | 604/87 |
| 6,840,373 | B2 * | 1/2005 | Gibler et al. | 206/219 |
| 2002/0096440 | A1 * | 7/2002 | Kasuya | 206/222 |

* cited by examiner

*Primary Examiner* — Jila Mohandesi
*Assistant Examiner* — Sharon M Prange

(57) ABSTRACT

A container closure is disclosed for retaining an additive material to mix with a container material within a container. The container closure comprises a reservoir having a sleeve and a plunger for retaining the additive material. A resilient seal is located at a first end of the sleeve and a frangible wall is located at a second end of the sleeve. The plunger is slidably received within the sleeve with the resilient seal interacting between the sleeve and the plunger. A severable member coacts between the base and the plunger for spacing a plunger projection from the frangible wall. The severable member is removable for enabling the plunger to be moved into a depressed position to fracture the frangible wall to permit the additive material to enter the container.

5 Claims, 10 Drawing Sheets

CONTAINER CLOSURE FOR RETAINING AN ADDITIVE MATERIAL

CROSS-REFERENCE TO RELATED APPLICATIONS

This application claims benefit of U.S. Patent Provisional application Ser. No. 60/545,690 filed Feb. 18, 2004. All subject matter set forth in provisional application Ser. No. 60/545,690 is hereby incorporated by reference into the present application as if fully set forth herein.

BACKGROUND OF THE INVENTION

1. Field of the Invention

This invention relates to closures and more particularly to a closure for retaining an additive material to mix with a container material within a container.

2. Background of the Invention

Various types of container closures have been proposed by the prior art for retaining an additive material for subsequent mixing with a container material within a container. Typically, the additive material was retained within a chamber having a frangible wall. A moving portion of the container closure pierced the frangible wall for enabling the additive material of the chamber to mix with the container material within the container. The following U.S. patents represent some of the attempts of the prior art to provide new and useful container closures for retaining an additive material.

U.S. Pat. No. 2,275,567 to Smith discloses a closure for the container having a chamber for a preparation therein. A seating disk is in sealing relation with the container and closing the bottom of the chamber. The closure has a hole in-the upper portion thereof. A puncturable diaphragm is located between the hole and the top of the chamber. A puncturing means is operatively connected with the cap to move therewith to puncture the diaphragm and enter the chamber and release the sealing disk.

U.S. Pat. No. 2,642,870 to Smith discloses a closure device comprising an inner body portion and a flexible outer closure. The body portion has a flanged portion adapted to engage the end of the neck of a bottle. The inner body portion has a sleeve portion adapted to fit within a bottle neck. The sleeve portion has an elastic, normally planar diaphragm intermediate the length thereof. There is an inner and an outer recess in the body portion with the diaphragm closing communication between the recesses. A closure member engages the inner body portion and includes a body portion closing the inner end of the inner recess. The closure member includes an annular side wall adapted to engage a bottle neck and an end flange adapted to engage the end of a bottle, and a medicinal preparation in the inner recess. The outer closure having an inwardly directed stem movable therewith, and a piercing tube carried by the stem. The piercing tube has a beveled sharpened point adapted to pierce the diaphragm and the closure member body portion.

U.S. Pat. No. 3,153,169 to Bowels et al discloses a bicameral package comprising mixing container having a pouring neck presenting a mouth portion, a cup fitting in the neck and adapted to be slidably removed therefrom. The cup has an outwardly extending peripheral flange fitting over the mouth portion. The peripheral flange has a greater diameter than the mouth portion and overlapping the peripheral edge of the mouth portion. A removable and replaceable cap is adapted to fit over and mechanically engage the neck removably and replaceably. The cap has a shoulder contacting the flange on the cup and pressing it downwardly toward the mouth portion to form a seal when the cap is fully engaged with the neck. The cap has an inwardly extending ridge portion spaced below the shoulder and forming therewith a retaining recess for receiving the overlapping portion of the peripheral flange of the cup and retaining the cup in the cap when the cap is removed from the neck, and a plunger fitting in the cup and is displaceable toward the bottom of the cup to remove a portion of the cup. The cap has a relatively rigid frangible top section above the plunger and the frangible section is adapted to be broken to permit access to the plunger for displacing the plunger toward the bottom of the cup to remove a portion of the cup and allow the contents of the cup to be mixed with the other contents of the container while the cap is in position on the neck of the container. The frangible section comprises a removable portion having a transverse dimension less than the transverse dimension of the top of the plunger so that the plunger cannot be displaced from the cup through the opening left in the top of the cap by displacement of the removable portion. The top of the plunger has a transverse dimension greater than the inside diameter of the cup for preventing the plunger from being removed from the cup through the bottom of the cup, whereby the cap containing the cup and the plunger may be removed easily from the pouring neck by unscrewing the cap from the neck to allow some of the mixture to be poured from the mixing container and the mixing container may be reclosed by screwing the cap back on the pouring neck and the cup and the plunger retained therein to complete the closure.

U.S. Pat. No. 3,347,410 to Schwartzman discloses an applicator for use with a container provided with a neck having an open end and having a first substance disposed therein. The applicator comprises a retainer ring having a projecting portion for reception in the neck, and a portion overlying the open end. The applicator further includes a fitting detachably engaging the outer surface of the neck, an applicator head having openings therethrough, a resilient bellows integral with the applicator head and the fitting and connecting the fitting to the applicator head. The projecting portion is provided at the lowermost end thereof with sealing means to hold a second substance within the retainer ring. A stem integrally depending from the applicator head is engageable with the sealing means upon depression of the applicator head and bellows to open the sealing means to permit the second substance to mix with the first substance. The bellows normally urges the stem away from the sealing means.

U.S. Pat. No. 3,968,872 to Cavazza discloses a dispenser and dispenser closure for storing two products separately in and on a necked container for eventual mixing thereof and dispensing them as a mixture. A sealed cup-shaped plug closes the container and has a bottom that is punchable or pierceable. The container contains a first material that is to be mixed with a second material contained in the cup-shaped plug externally of the container interior. A dispensing element which is a tubular punching piston is disposed slidable axially in the cup and is provided with a leading edge at an inner open end for punching or piercing the plug's bottom for introducing the second material into the container upon being depressed. The punching piston fixed therein coaxially therewith a dispensing tube open at both ends. A removable cover closes an outer end of the tube and removed therefrom automatically upon the punching piston being displaced. The mixture contents are dispensed through the dispensing tube by first depressing the punching piston and then inverting the container once the mixture has been effected.

U.S. Pat. No. 4,550,825 to Sutryn, et al. discloses a composite package adapted for initially separately containing a dry medicament and a diluent therefore. The diluent containing package portion being a collapsible bag with an I.V. set fitment attachment port and an injection port, and a dry medicament containing receptacle container. The dry medicament container includes an open end cylinder sealingly engageably mountable in a top opening in the collapsible bag. The cylinder having an elastomeric bottom closure plug therein. A top plunger means constitutes a top cylinder closure and a final seal for the container. The plunger is depressible within the cylinder, and operable to displace the bottom closure plug to open the cylinder bottom for discharge therefrom, and subsequent mixing of the dry medicament in the diluent in the collapsible bag for subsequent disbursement of the mixture therefrom.

U.S. Pat. No. 4,638,927 to Morane discloses a container comprising a bottle for a liquid product and having at the end of its neck a leakproof envelope enclosing an additional product to be stored separately from the liquid in the bottle. A cap on the neck includes a slidable push button carrying a perforator to open the envelope in a central region of the envelope to allow the additional product to mix with the liquid and then to be discharged through an eccentric duct in the cap rather than having to pass through the center of the cap where the perforator is positioned.

U.S. Pat. No. 5,128,104 to Murphy et al. discloses a consumable, non-reusable cuvette for containing a sample or specimen during an automated test thereof, primarily for medical diagnostic purposes. The cuvette has a single, main reaction chamber that is pre-loaded at the factory with the precise quantity of a particular liquid or dry reagent useful for a specific test. The cover of the cuvette includes an opening to permit the introduction of a diluent or liquid reagent into the reagent chamber, a manually loaded, recessed sample receiving chamber having a frangible bottom floor and a purge reservoir. A cap is hinged to the cuvette cover and includes a rigid protruding member that pierces the sample or specimen chamber floor when closed by the testing machine, sealing the contents of the cuvette, allowing the sample to be dispensed into the chamber containing the reagent and diluent. The side walls and floor of the reaction chamber include optically transparent windows for radiant energy testing of the reagent before and after the sample is added to the reagent. Because the cap seals the contents of the cuvette, the cuvette is safely disposable after the test is completed.

U.S. Pat. No. 5,782,345 to Guasch et al. discloses a container including a bottom container closed at a bottom end and open at a top end and having a tubular neck, a top container open at a top end and closed at a bottom by a tearable seal, a flap extending radially out from an exterior of the top container so that the flap surrounds the neck of the bottom container, and a tubular sleeve having a bottom end and a top end. The bottom end defined by a beveled edge and the top end closed by a truncated cone. The bottom end of the tubular sleeve being sized and shaped to be received within the open end of the top container. The tubular neck has a peripheral edge containing a first set of stria, and an interior of the tubular neck has a plurality of sealing rings. The top container engages the sealing rings of the bottom container, and the flap surrounds the neck of the bottom container, when the top container is inserted into the interior of the tubular neck. The bottom end of the tubular sleeve has a beveled edge and the top end is closed by a truncated cone. The tubular sleeve may be moved axially within the top container so that the beveled edge tears the tearable seal in the top container.

U.S. Pat. No. 6,230,884 to Coory discloses a cap for a container where a drink, made of two components, can be stored or carried with the components stored separately. The components are mixed prior to the consumption of the drink. The cap includes a collar secured to the container and a top which is in two parts. The top is moveable between an open and a closed position. When the top is initially in the open position, a basket between the top and the liquid initially holds the material, which can be a powder or tablet. The top is initially closed to release the seal between the liquid and the material, the drink is shaken, and the top reopened for a passageway from the liquid to the exterior of the cap. A cover is releasably secured over the cap.

Although the aforementioned U.S. patents have set forth interesting solutions for the closure art, none of these container closures have satisfied the need of the closure art.

Therefore, it is an object of the present invention to provide an improved container closure for retaining an additive material to mix with a container material within a container with improved performance over the prior art.

Another object of this invention is to provide an improved container closure for retaining an additive material wherein the additive material is retained in a tamper evident condition.

Another object of this invention is to provide an improved container closure for retaining an additive material wherein the additive material may be mixed with a container material within a container upon the depression of an externally extending plunger.

Another object of this invention is to provide an improved container closure for retaining an additive material wherein the improved container closure may be formed as a two piece assembly.

Another object of this invention is to provide an improved container closure for retaining an additive material wherein the improved container closure may be formed as a three piece assembly with a conventional closure.

Another object of this invention is to provide an improved container closure for retaining an additive material wherein the additive material may be mixed with a container material and be dispensed through the improved container closure.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an improved container closure for retaining an additive material to mix with a container material within a container. The container closure comprises a base for sealing with an opening in the container. A reservoir comprises a sleeve and a plunger for retaining the additive material. The sleeve extends between a first end and a second end. A resilient seal is located in proximity to the first end of the sleeve. A frangible wall is located in proximity to the second end of the sleeve. A plunger extends between a first end and a second end. An end wall is located in proximity to the first end of the plunger with a projection being located on the second end of the plunger. The plunger is slidably received within the sleeve with the resilient seal interacting between the sleeve and the plunger. A severable member coacts between the base and the plunger for spacing the projection from the frangible wall. The severable member is removable for enabling the plunger to be moved into a depressed position to fracture the frangible wall with the projection to permit the additive material to enter the container.

The base includes a sealing flange for sealing with a peripheral rim of an opening in the container. A mounting secures the base to the container. In one example, the mounting is integrally formed with the base. Preferably, the sleeve is integrally formed with the base. In one embodiment, the sleeve comprises a cylindrical sleeve for telescopically receiving the plunger.

The resilient seal comprises a resilient chevron seal extending between a proximal end and a distal end with the proximal end of the chevron seal being secured to the sleeve. The resilient chevron seal tapers from the proximal end to the distal end for increasing the flexibility of the resilient seal.

In one embodiment, the frangible wall is integrally formed with the sleeve. In an alternate embodiment, the frangible wall is secured to the second end of the sleeve. The frangible wall may comprise a flexible film secured to the second end of the sleeve.

Preferably, the projection of the plunger includes an arcuate distal end for piercing the frangible wall. The plunger may include an interruption for inhibiting the cutting of a portion of the frangible wall.

In a specific embodiment of the invention, the severable member is interposed between the base and the plunger for spacing the projection from the frangible wall. The severable member is removable for enabling the plunger to be moved into a depressed position to fracture the frangible wall with the projection to permit the additive material to enter the container. Preferably, the severable member is integrally formed with the plunger.

The container closure may include a first and a second plunger lock. The first plunger lock inhibits the removal of the plunger from the sleeve when the plunger is in an extended position. The second plunger lock inhibits the removal of the plunger from the sleeve when the plunger is in the depressed position.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

Similar reference characters refer to similar parts throughout the several Figures of the drawings.

DETAILED DISCUSSION

Figure 1:
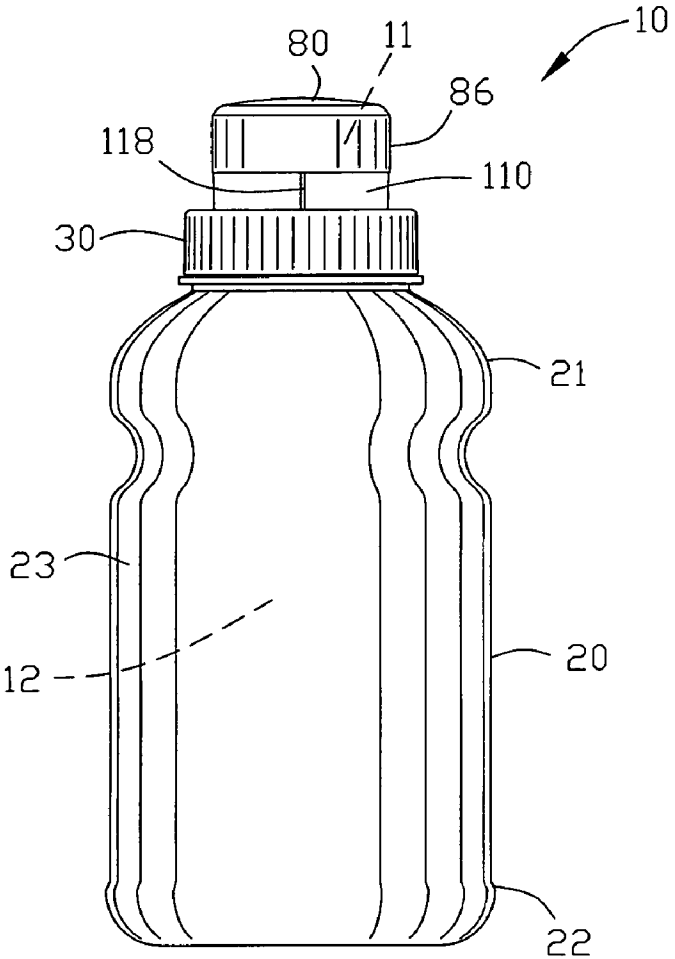
FIG. 1 is an elevational view of a first embodiment of the container closure of the present invention secured to a container.

FIG. 1 is an elevational view of a first embodiment of the improved container closure 10 of the present invention. The container closure 10 retains an additive material 11 to mix with a container material 12 within a container 20. The container 20 is shown as a cylindrical container of conventional design and material but is should be understood that the improved container closure 10 of the present invention may be used with containers of various shapes and designs. The container 20 extends between a top portion 21 and a bottom portion 22 and defines a sidewall 23.

Figure 2:
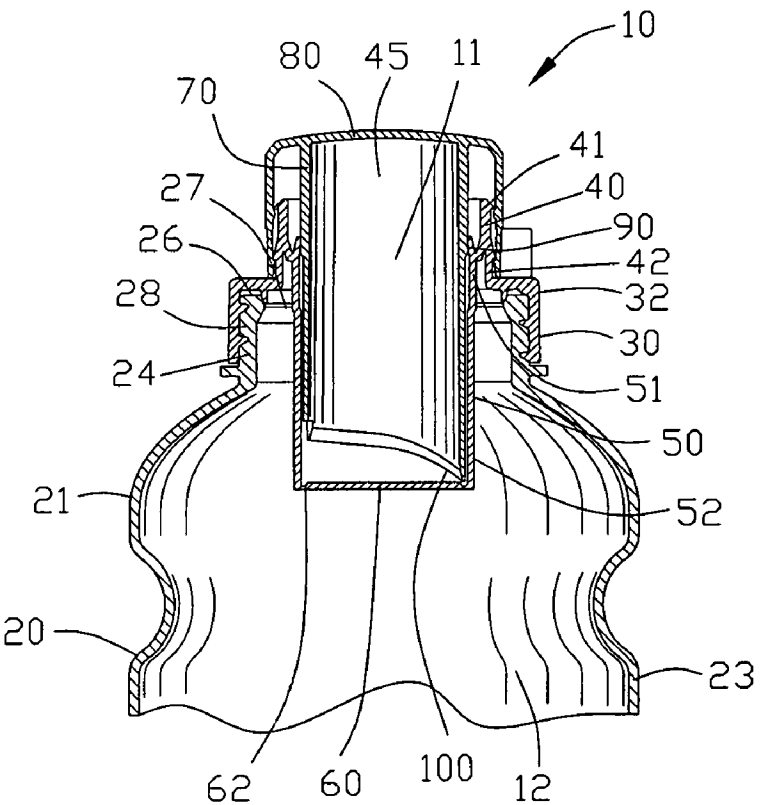
FIG. 2 is an enlarged sectional view of a portion of FIG. 1.

FIG. 2 is an enlarged sectional view of a portion of FIG. 1 illustrating the container closure 10 secured to the container 20. The top portion 21 of the container 20 tapers radially inwardly into a neck 24 terminating in a peripheral rim 26 having an opening 27. A container mounting 28 is located on the outer portion of the neck for securing the closure 10 to the container 20. In this example, the container mounting 28 is shown as threads integrally molded into the neck 24 of the container 20. However, it should be understood that any suitable mounting may be used for securing the container closure 10 to the container 20 such as a removable mounting or a tamper evident mounting depending upon the desired end use.

Figure 4:
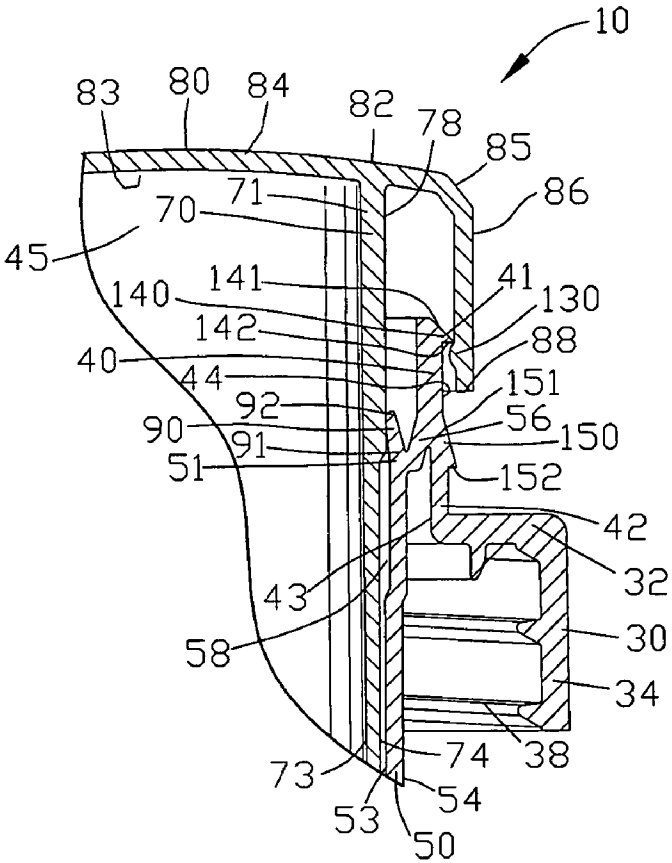
FIG. 4 is a view similar to FIG. 3 with the severable member removed from the container closure.
Figure 3:
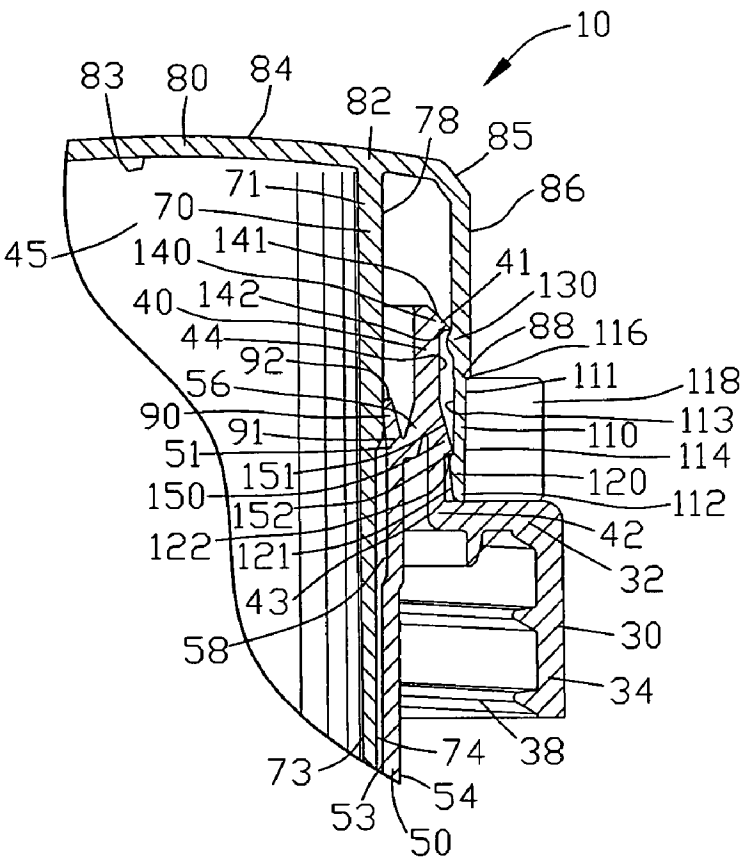
FIG. 3 is a magnified view of an upper portion of FIG. 2 with a severable member attached to the closure.
Figure 6:
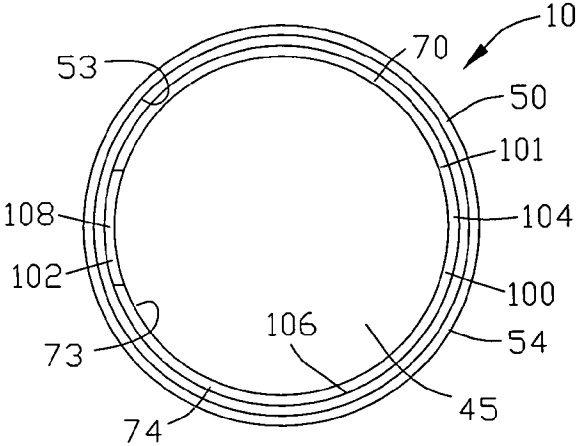
FIG. 6 is a sectional view along line 6-6 in FIG. 5.
Figure 8:
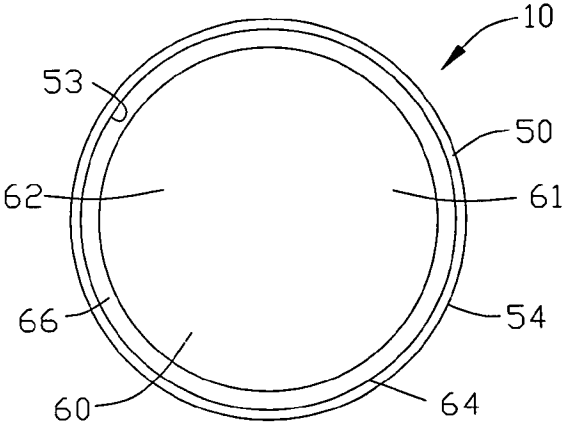
FIG. 8 is a sectional view along line 8-8 in FIG. 5.

FIGS. 3 and 4 are magnified views of the upper portion of FIG. 2. The container closure 10 comprises a base 30 for sealing with the container 20. In this embodiment, the base 30 includes a sealing flange 32 for sealing with the peripheral rim 26 surrounding the opening 27 in the container 20. The container closure 10 includes a mounting cap 34 integrally formed with the flange 32. The mounting cap 34 includes a closure mounting 38 for securing the container closure 10 to the container 20. In this example, the closure mounting 38 is shown as threads integrally molded into the mounting cap 34 of the container closure 10.

The container closure 20 includes a support wall 40 extending between a first end and a second end 41 and 42 and defining an inner sidewall 43 and an outer sidewall 44. Preferably, the support wall 40 is integrally formed with the base 30. In this example, the support wall 40 is shown having a circular cross-section but it should be understood that the support wall 40 may incorporate other cross-sections.

The container closure 20 includes a reservoir 45 for retaining the additive material 11. The reservoir 45 is defined by a sleeve 50, a frangible wall 60, a plunger 70 and a plunger end wall 80. The sleeve 50 telescopically receives the plunger 70 for forming the reservoir 45. Preferably, the sleeve 50 and a plunger 70 are formed from a polymeric material such as polypropylene or polyethylene or the like.

The sleeve 50 extends between a first end and a second end 51 and 52 and defines an inner sidewall 53 and an outer sidewall 54. In this example, the sleeve 50 is shown having a circular cross-section but it should be understood that the sleeve 50 may incorporate other cross-sections. A bridge 56 located between the first and second ends 41 and 42 of the support wall 40 interconnects the inner surface 43 of the support wall 40 to the first end 51 of the sleeve 50. The bridge 56 is integrally formed with the support wall 40 and the sleeve 50. A recessed portion 58 is located in the inner sidewall 53 of the first end 51 of the sleeve 50.

A resilient seal 90 is located in proximity to the first end 51 of the sleeve 50. The resilient seal 90 forms a sliding resilient seal with the plunger 70. The resilient seal 90 is shown as a resilient chevron seal extending between a proximal end 91 and a distal end 92. The proximal end 91 of the resilient chevron seal 90 is integrally formed with the recessed portion 58 of the inner sidewall 53 of the sleeve 50. The resilient chevron seal 90 tapers from a wide proximal end 91 to a narrow distal end 92 for increasing the resiliency of the distal end 92 of the resilient seal 90.

FIGS. 5-8 are magnified views of the lower portion of the sleeve 50 and plunger 70 shown in FIG. 2. The frangible wall 60 is located in proximity to the second end 52 of the sleeve 50. In this embodiment, the frangible wall 60 is integrally formed with the sleeve 50. As will be described in greater detail, the frangible wall 60 may be considered to have a first and a second portion 61 and 62.

The frangible wall 60 includes a peripheral region 64 for affixing the frangible wall 60 to the second end 52 of the sleeve 50. In this embodiment, the peripheral region 64 of the frangible wall 60 has been shown integrally formed with the sleeve 50. However, it should be understood that the frangible wall 60 may be a separate member secured to the second end 52 of the sleeve 50. The frangible wall 60 includes a circular weakening 66 disposed adjacent to the inner sidewall 53 of the sleeve 50.

The plunger 70 extends between a first end and a second end 71 and 72 and defines an inner sidewall 73 and an outer sidewall 74. The plunger 70 is shown having a circular cross-section. The outer sidewall 74 of the second end 72 of the plunger 70 forms a telescopic engagement with the inner sidewall 53 of the second end 52 of the sleeve 50. The sleeve 50 and the plunger 70 are dimensioned to provide a non-sealing telescopic sliding engagement between the sleeve 50 and the plunger 70.

As best shown in FIGS. 3 and 4, an expanded portion 78 is located in the outer sidewall 74 of the first end 71 of the plunger 70. The expanded portion 78 provides a sealing surface for cooperation with the resilient chevron seal 90. The distal end 92 of the resilient chevron seal 90 resiliently engages the expanded portion 78 of the plunger 70 for forming a sliding seal between the sleeve 50 and the plunger 70.

In this embodiment, the base 30, the support wall 40 and the sleeve 50 are molded as a single piece in an injection molding process. Similarly, the plunger 70 and the plunger end wall 80 are molded as a single piece in an injection molding process. The recessed portion 58 in the sleeve 50 and the expanded portion 78 in the plunger 70 are provided to reduce degradation of the resilient chevron seal 90 during the injection molding process of the sleeve 50 and during the injection molding process of the plunger 70.

After the injection molding process, the distal end 92 of the resilient chevron seal 90 extends to an inner diameter commensurate with the inner sidewall 53 of the second end 52 of the sleeve 50. Accordingly, only a portion of a core pin (not shown) engaging the recessed portion 58 will contact the resilient chevron seal 90 during the extraction of the core pin (not shown) after the injection molding process.

When the plunger 70 is slidably engaged with the sleeve 50, the expanded portion 78 of the plunger 70 compresses the distal end 92 of the resilient chevron seal 90. The distal end 92 of the resilient chevron seal 90 forms a resilient seal with the expanded portion 78 to form a seal between the sleeve 50 and the plunger 70. The resilient between the seal resilient chevron seal 90 and the plunger 70 allows a non-sealing telescopic sliding engagement between the sleeve 50 and the plunger 70. Furthermore, the seal between the resilient chevron seal 90 and the plunger 70 eliminates the need for exact dimensional tolerance between the sleeve 50 and the plunger 70 during the injection molding process.

The plunger 70 includes the plunger end wall 80 formed at the first end 71 of the plunger 70 and a plunger projection 100 formed at the second end 72 of the plunger 70. The plunger end wall 80 will be described in greater detail hereinafter.

The plunger projection 100 is defined in the second end 72 of the plunger 70. The second end 72 of the plunger 70 defines a first portion 101 and a second portion 102. The second end 72 of the plunger 70 is cut on an angle relative to an axis of symmetry of the plunger 70 to provide the projection 100. In this example, the first portion 101 of the plunger 70 is cut arcuately to provide an acute distal end 104 for piercing the frangible wall 60. The remainder of the first portion 101 the second end 72 of the plunger 70 defines a cutting edge 106 for cutting a first portion 61 of the frangible wall 60.

The second portion 102 of the second end 72 of the plunger 70 provides an interruption 108 in the cutting edge 106. The interruption 108 is shown as a notch for inhibiting the cutting of the second portion 62 of the frangible wall 60. The configuration of the second end 72 of the plunger 70 insures that only the first portion 61 of the frangible wall 60 is severed whereas the second portion 62 of the frangible wall 60 remains in affixed to the sleeve 50.

Referring back to FIGS. 1-4, the plunger end wall 80 has a circular region 82 integrally secured to the first end 71 of the plunger 70. The plunger end wall 80 defines an inner wall surface 83 and an outer wall surface 84. The plunger end wall 80 extends outwardly from the circular region 82 to a bend 85. The bend 85 supports a depending skirt 86 terminating in a circular end 88. Preferably, the plunger end wall 80 and the depending skirt 86 are formed as an integral unit.

A severable member 110 is secured to the circular end 88 of the depending skirt 86. The severable member 110 extends between a first end and a second end 111 and 112 and defines an inner sidewall 113 and an outer sidewall 114. The first end 111 of the severable member 110 is integrally formed with the circular end 88 of the depending skirt 86 by a breakable coupling 116. The breakable coupling 116 is formed by a reduced thickness of material about the circular end 88 of the depending skirt 86. A gripping tab 118 is integrally affixed to the severable member 110 for breaking the breakable coupling 116.

The second end 112 of the severable member 110 engages the sealing flange 32 for inhibiting depression of the plunger 70 relative to the frangible wall 60 to prevent the plunger projection 100 from piercing the frangible wall 60.

A severable member lock 120 is located on the second end 112 of the severable member 110. The severable member lock 120 is integrally formed with the severable member 110 to extend inwardly from the inner wall surface 113 of the severable member 110. The severable member lock 120 comprises a triangularly shaped projection having a ramping surface 121 and a locking surface 122.

A plunger lock 130 is located on the depending skirt 86 of the plunger 70. In this embodiment, the plunger lock 130 comprises an annular projection extending inwardly from the inner wall surface 83 of the depending skirt 86. The plunger lock 130 is integrally formed with the inner wall surface 83 of the depending skirt 86.

A first and a second support wall lock 140 and 150 extend from the outer wall surface 44 of the support wall 40. The first and the second support wall lock 140 and 150 are located in proximity to the first end and the second end 41 and 42 of the support wall 40. The first and second support wall locks 140 and 150 are integrally formed with the support wall 40.

The first support wall lock 140 comprises a triangularly shaped projection having a ramping surface 141 and a locking surface 142. The ramping surface 141 and the locking surface 142 of the first support wall lock 140 is inverted relative to the ramping surface 121 and the locking surface 122 of the severable member lock 120. As will be described in greater detail hereinafter, the first support wall lock 140 cooperates with the plunger lock 130 to secure the plunger 70 in an extended position as shown in FIGS. 1-4.

The second support wall lock 150 comprises a triangularly shaped projection having a ramping surface 151 and a locking surface 152. The ramping surface 151 and the locking surface 152 of the second support wall lock 150 is inverted relative to the ramping surface 121 and the locking surface 122 of the severable member lock 120. The ramping surface 151 of the second support wall lock 150 extends outwardly a slightly greater distance than the ramping surface 141 of the first support wall lock 140. As will be described in greater detail hereinafter, the second support wall lock 150 cooperates with the severable member lock 120 to secure the plunger 70 in the extended position as shown in FIGS. 1-4.

The first support wall lock 140 cooperates with the plunger lock 130 to secure the plunger 70 in an extended position as shown in FIGS. 1-4. Similarly, the second support wall lock 150 cooperates with the severable member lock 120 to secure the plunger 70 in an extended position. The first and second support wall locks 140 and 150 act in unison to secure the plunger 70 in the extended position and to prevent removal of the plunger 70 from the extended position as shown in FIG. 1-3.

FIG. 4 illustrates the severable member 110 removed from the circular end 88 of the depending skirt 86. The gripping tab 118 enables an operator to sever the breakable coupling 116 to remove the severable member 110 from the circular end 88 of the depending skirt 86. The removal of the severable member 110 removes the severable member lock 120 located on the second end 112 of the severable member 110. After the removal of the severable member lock 120, the first support wall lock 140 remains engaged with the plunger lock 130 to prevent removal of the plunger 70 from the extended position as shown in FIG. 1-3.

Figure 9:
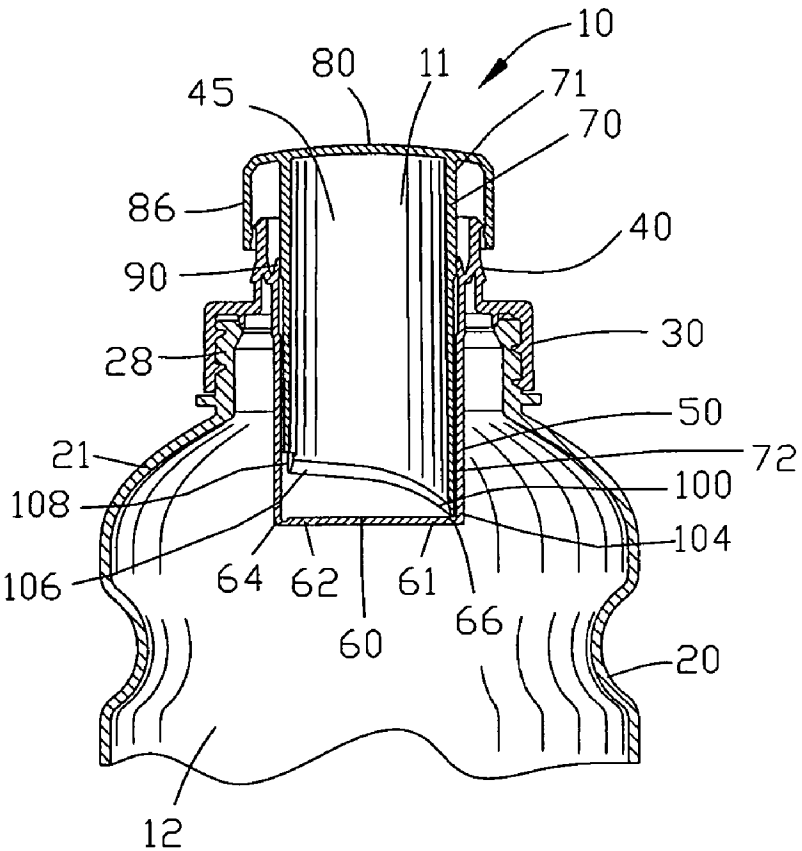
FIG. 9 is a view similar to FIG. 2 with the severable member removed from the container closure.

FIG. 9 is a view similar to FIG. 2 after the removal of the severable member 110. The removal of the severable member 110 enables an operator to depress the plunger 70 relative to the sleeve 50 to pierce the frangible wall 60. The piercing of the frangible wall 60 permits the additive material 11 to enter the container 20 to mix with the container material 12.

Figure 10:
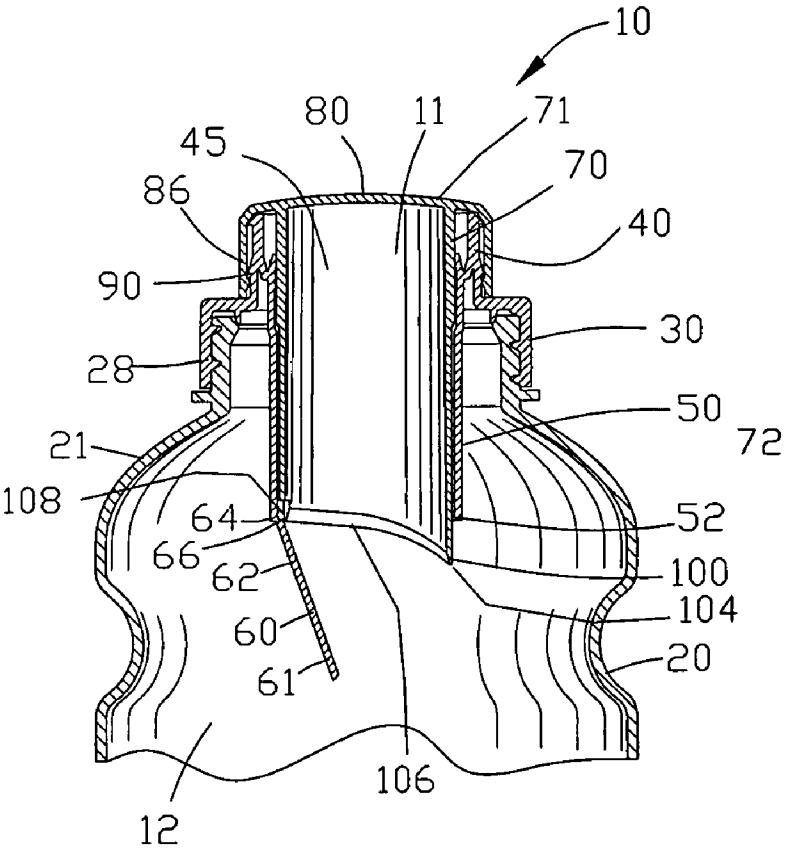
FIG. 10 is a view similar to FIG. 2 with a plunger moved into a depressed position to pierce a frangible wall.

FIG. 10 is a view similar to FIG. 9 with the plunger 70 moved into a depressed position to pierce a frangible wall 60. The circular end 88 of the depending skirt 86 engages the sealing flange 32 of the base to limit the downward movement of the plunger 70. The plunger projection 100 pierces the frangible wall 60 upon depression of the plunger 70 by an operator. More specifically, the acute distal end 104 pierces the first portion 61 of the frangible wall 60. The sharpness of the acute distal end 104 enables an operator to pierces the first portion 61 of the frangible wall 60 with less depression force.

After the acute distal end 104 pierces the first portion 61 of the frangible wall 60, the remainder of the first portion 61 of the frangible wall 60 is severed by the cutting edge 106 of the plunger 70. The remainder of the first portion 61 of the frangible wall 60 is severed upon continued depression of the plunger 70. The sharpness of the cutting edge 106 enables an operator to pierce the remainder of the first portion 61 of the frangible wall 60 with less depression force.

The enlarged surface area of the plunger end wall 80 provides a large surface area for an operator to apply the depression force to the plunger 70. The depression force applied to the plunger end wall 80 is multiplied to provide a high cutting pressure at the acute distal end 104 of the plunger 70. The depression pressure applied to the plunger end wall 80 located at the first end 71 of the plunger 70 is multiplied by the ratio of the surface area of the plunger end wall 80 divided by the surface area of the acute distal end 104.

The depression force applied to the plunger end wall 80 is multiplied to provide a high cutting pressure at the cutting edge 106 of the plunger 70. The depression pressure applied to the first end 71 of the plunger 70 is multiplied by the ratio of the surface area of the plunger end wall 80 divided by the surface area of the cutting edge 106 of the plunger 70. The multiplication of the pressure applied to the plunger end wall 80 enables the operator to pierce the first portion 61 of the frangible wall 60 with less depression force.

The interruption 108 is located in the cutting edge 106 adjacent to the second portion 62 of the frangible wall 60. In this example, the interruption 108 is shown as a notch in the cutting edge 106, but it should be understood that the interruption 108 may take various forms, structures and configurations.

The interruption 108 inhibits the cutting edge 106 from severing the second portion 62 of the frangible wall 60. The configuration of the second end 72 of the plunger 70 insures that only the first portion 61 of the frangible wall 60 is severed whereas the second portion 62 of the frangible wall 60 remains in affixed to the sleeve 50. The additive material 11 is added to the container material 12 within the container 20 through an opening formed by the severing of the first portion 61 of the frangible wall 60. The second portion 62 of the frangible wall 60 insures that the frangible wall 60 remains affixed to the sleeve 50 and is prevented from entering into the container 20.

Figure 11:
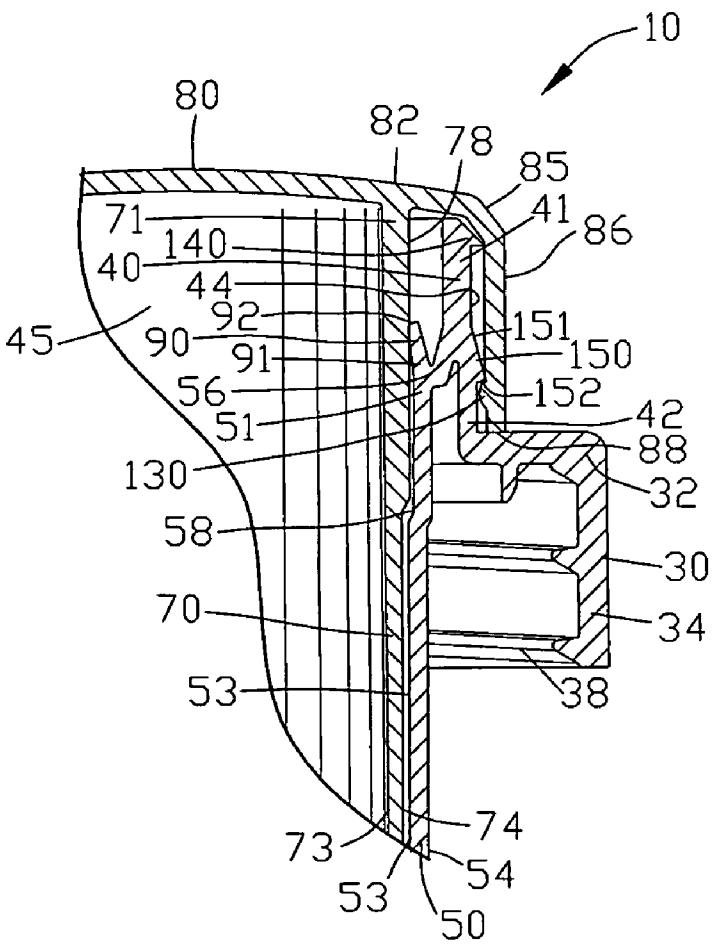
FIG. 11 is a magnified view of an upper portion of FIG. 10 with a plunger lock inhibiting removal of the plunger.

FIG. 11 is an enlarged view of the upper portion of FIG. 10. The plunger 70 is shown in the depressed position with the circular end 88 of the depending skirt 86 engaging the sealing flange 32. The engagement of the circular end 88 with the sealing flange 32 limits the downward movement of the plunger 70.

When the circular end 88 engages the sealing flange 32, the plunger lock 130 engages with the second support wall lock 150 to secure the plunger 70 in the depressed position as shown in FIGS. 10 and 11. The second support wall lock 150 cooperates with the plunger lock 130 to prevent removal of the plunger 70 from the depressed position.

The resilient seal 90 continues the sliding seal between the base 40 and the plunger 70 during the depression of the plunger 70. The resilient seal 90 maintains the seal between the base 40 and the plunger 70 when the plunger 70 is locked in the depressed position.

FIG. 10 illustrates the additive material 11 added to the container material 12 within the container 20. The additive material 11 may be mixed with the container material 12 by shaking the container 20. The mixture of the additive material 11 and the container material 12 is dispensed from the container 20 by removing the container closure 10 from the container 20. The base mounting 38 is disengaged from the container mounting 28 for removing the container closure 10 from the container 20. The mixture of the additive material 11 and the container material 12 is dispensed from the opening 27 in the container 20.

Figure 5:
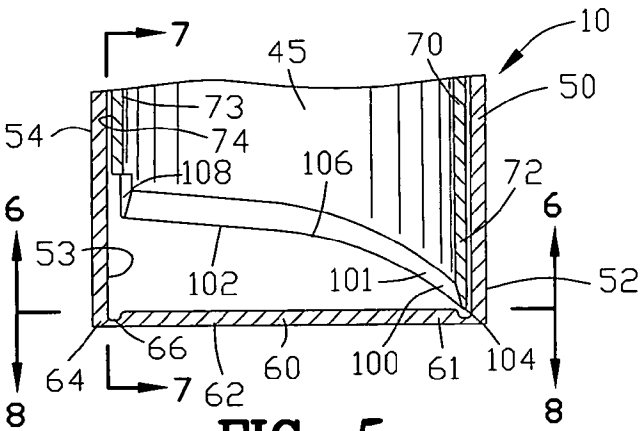
FIG. 5 is a magnified view of a lower portion of FIG. 2.
Figure 7:
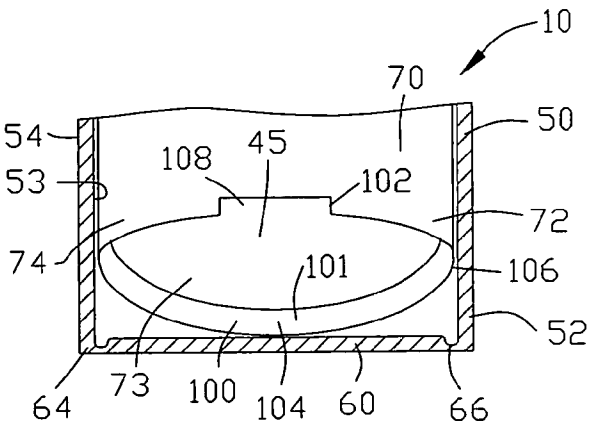
FIG. 7 is a view along line 7-7 in FIG. 5.
Figure 12:
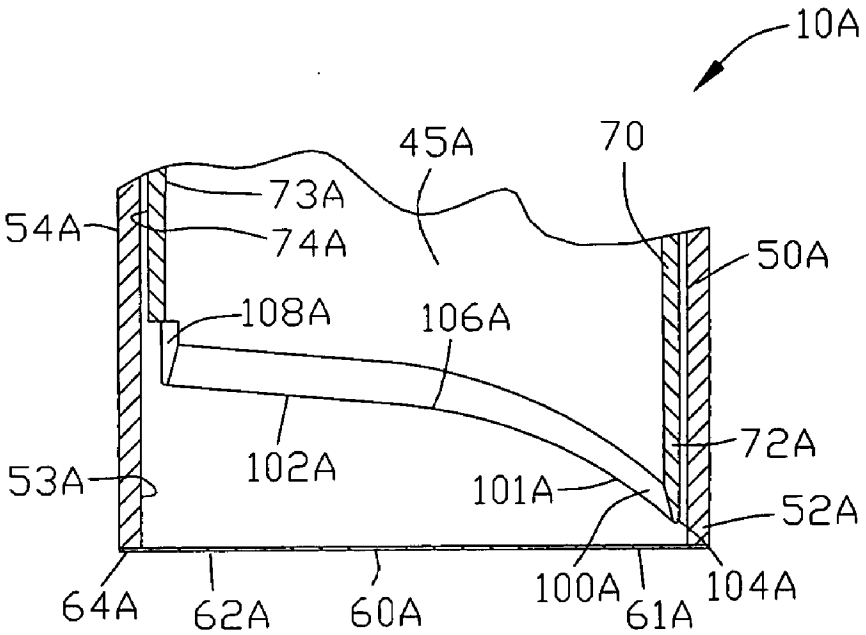
FIG. 12 illustrates an alternate embodiment of the container closure with a thin film frangible wall.

FIG. 12 is a view similar to FIG. 5 illustrating a variation of the frangible wall 60A. Similar parts are labeled with similar reference numerals with a different alphabetical addition. In this embodiment, the frangible wall 60A comprises a flexible thin film secured to the second end 52A of the sleeve 50A. The flexible thin film of the frangible wall 60A includes a peripheral region 64A for affixing the frangible wall 60A to the second end 52A of the sleeve 50A. The flexible thin film is uniform throughout the frangible wall 60A including the peripheral region 64A.

The flexible thin film of the frangible wall 60A may be formed from a variety of materials such as a thin film metallic material, a thin film polymeric material, or any other suitable material. The peripheral region 64A may be secured to the second end 52A of the sleeve 50A by various methods including an adhesive, ultrasonically welded, heat-sealed or any other suitable means.

Figure 14:
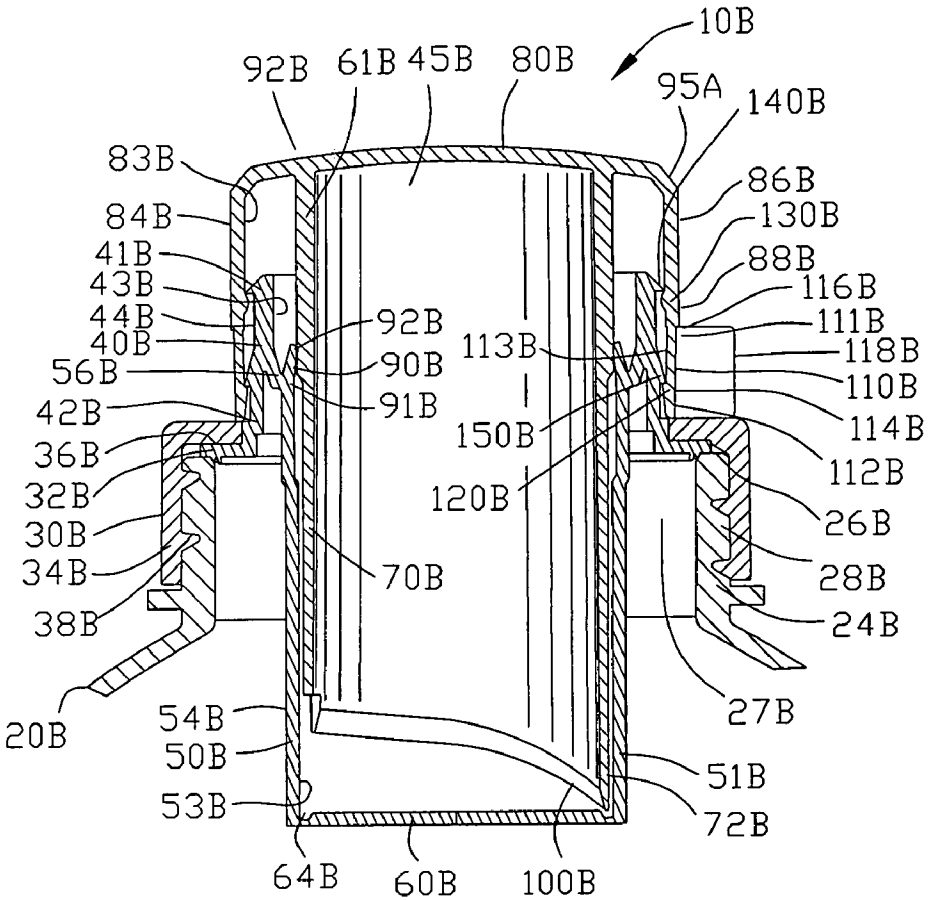
FIG. 14 is an enlarged sectional view of a portion of FIG. 13.
Figure 13:
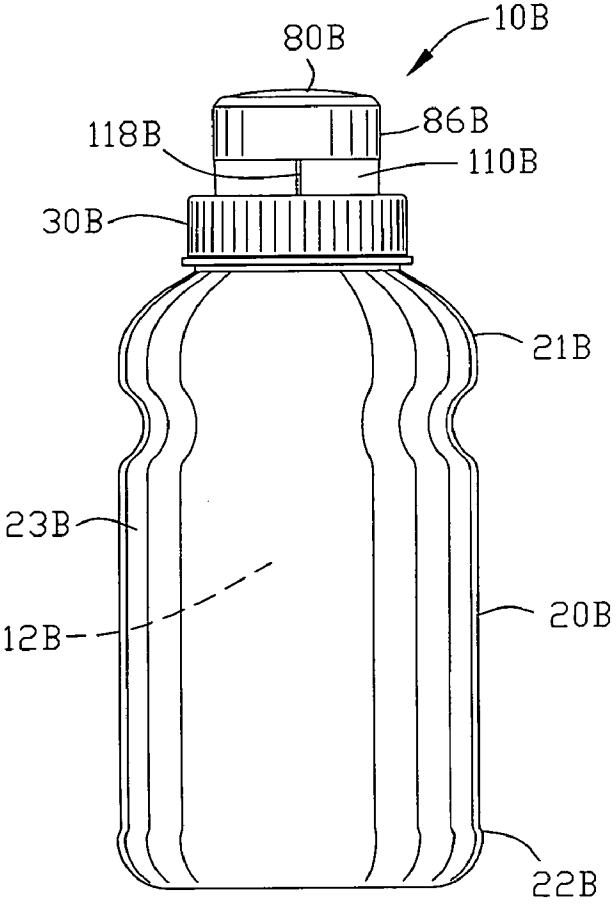
FIG. 13 is an elevational view of a second embodiment of the container closure of the present invention secured to a container.

FIGS. 13 and 14 are elevational and enlarged sectional views of a second embodiment of the container closure 10B of the present invention secured to a container 20B. Similar parts are labeled with similar reference numerals with a different alphabetical addition. In this embodiment, the base 30B includes a sealing flange 32B for sealing with the peripheral rim 26B surrounding the opening 27B in the container 20B. The container closure 10B includes a mounting cap 34B having a dome surface 36B.

In contrast to FIGS. 1-12, the sealing flange 32B is separate and distinct from the mounting cap 34B. The mounting cap 34B is separately molded from the sealing flange 32B. The sealing flange 32B is received within the dome surface 36B of the mounting cap 34B. The mounting cap 34B includes a closure mounting 38B for securing the sealing flange 32B of the container closure 10B to the peripheral rim 27B of the container 20B.

The container closure 10B may be adapted for use with a wide variety of different containers 20B. Since the mounting cap 34B is separately molded from the sealing flange 32B, the support wall 40B and the sleeve 50B of the container closure 10B, different sizes and types of mounting caps 34B may be molded to accommodate for a wide variety of different sizes and types of containers 20B. The different sizes and types of mounting caps 34B secure the same sealing flange 32B, the support wall 40B and the sleeve 50B to a wide variety of different sizes and types of containers 20B.

Figure 15:
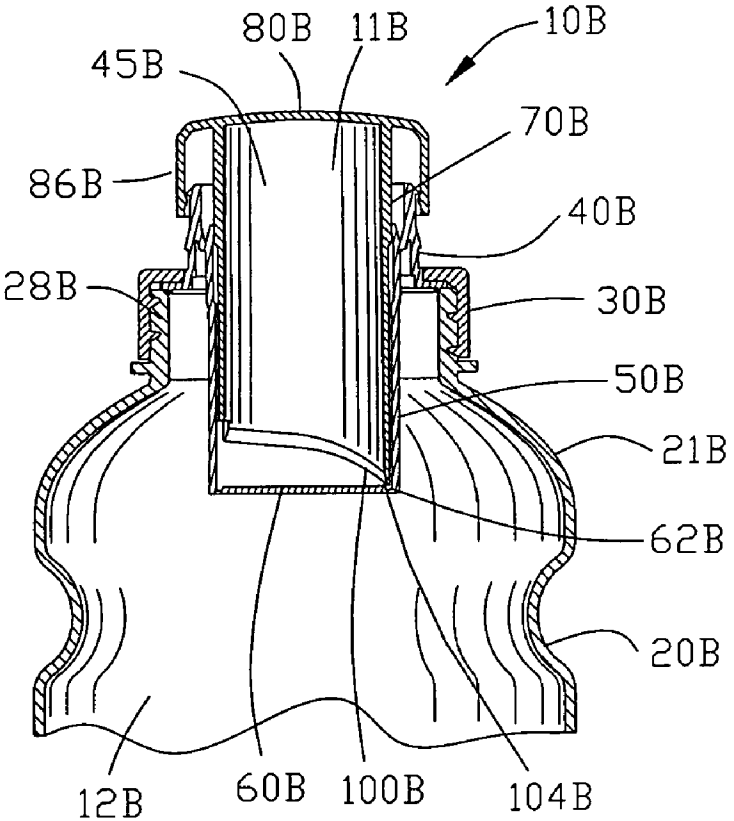
FIG. 15 is a view of the container closure of FIGS. 13 and 14 with the severable member removed from the container closure.

FIG. 15 is a view of the container closure 10B of FIGS. 13 and 14 with the severable member 110B removed from the container closure 10B. The removal of the severable member 110B enables the operator to depress the plunger 70B relative to the sleeve 50B to pierce the frangible wall 60B. The fracture of the frangible wall 60B permits the additive material 11 to enter the container 20B to mix with the container material 12B.

Figure 16:
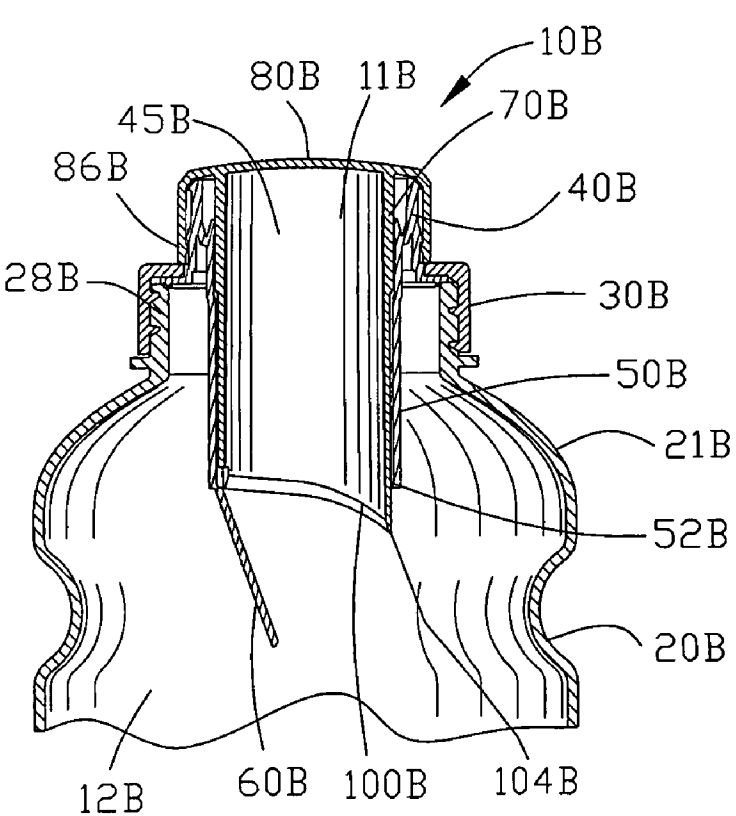
FIG. 16 is a view similar to FIG. 15 with the plunger moved into a depressed position to pierce a frangible wall.

FIG. 16 is a view similar to FIG. 15 with the plunger 70B moved into a depressed position to pierce the frangible wall 60B. The acute distal end 104B of the plunger projection 100B pierces the frangible wall 60B upon depression of the plunger 70B by the operator. Although the frangible wall 60B has been shown integrally affixed to the sleeve 50B, it should be appreciated that various types of frangible walls 60B may be used with the present invention.

Figure 18:
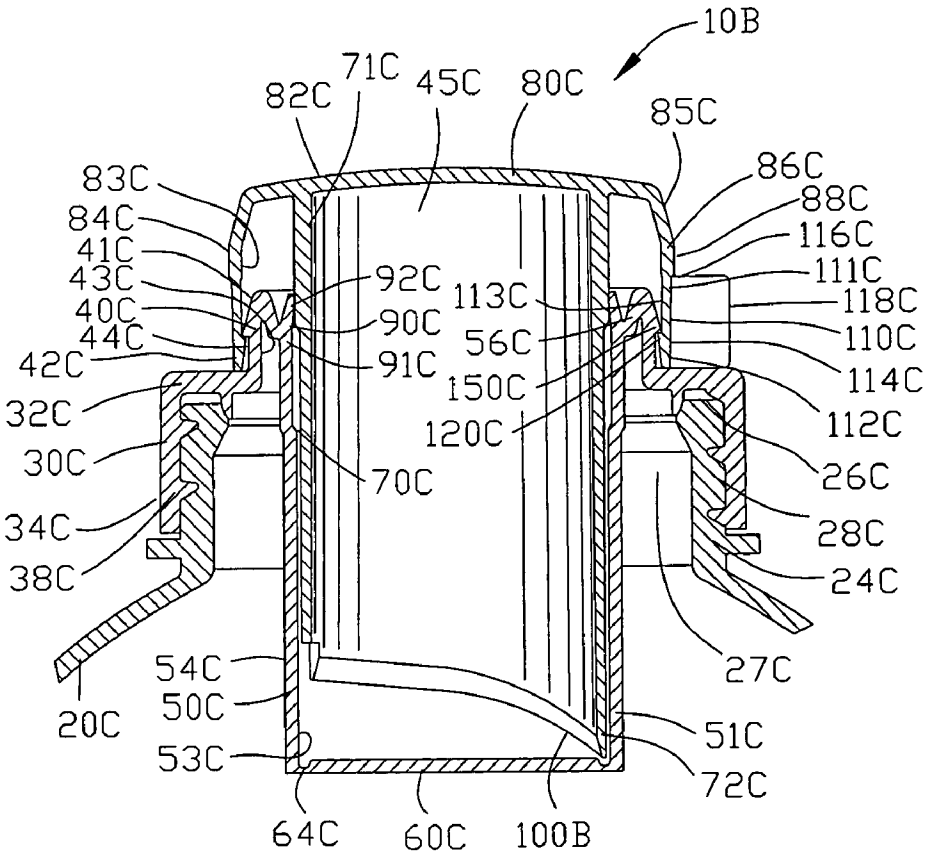
FIG. 18 is an enlarged sectional view of a portion of FIG. 17.
Figure 17:
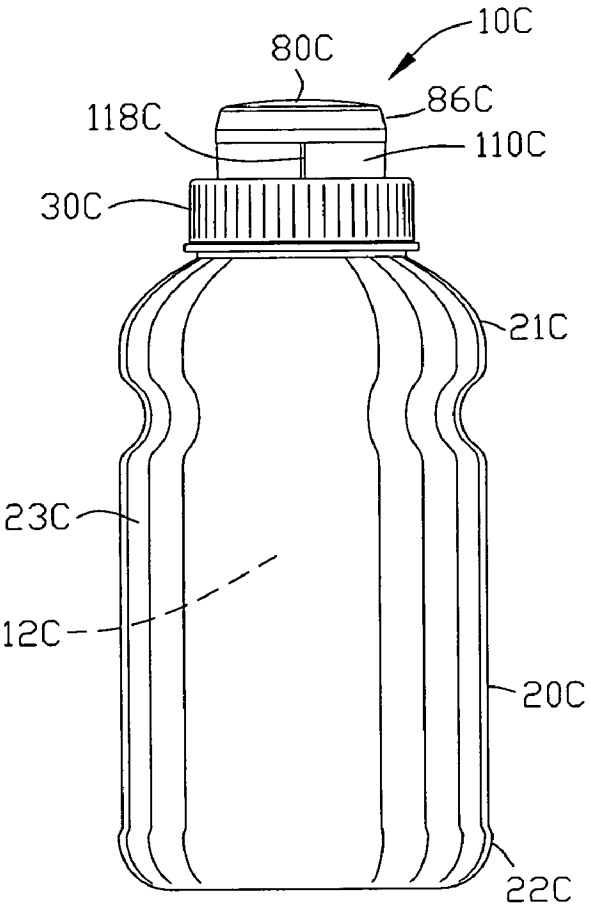
FIG. 17 is an elevational view of a third embodiment of the container closure of the present invention secured to a container.

FIGS. 17 and 18 are elevational and enlarged sectional views of a third embodiment of the container closure 10C of the present invention secured to the container 20C. Similar parts are labeled with similar reference numerals with a different alphabetical addition. In this embodiment, the support wall 40C includes a single support wall lock 150C extending from the outer wall surface 44C of the support wall 40C. The support wall lock 150C is located in proximity to the second end 42C of the support wall 40C. In further contrast to the previous embodiments, the depending skirt 86C of the plunger 70C lacks the plunger lock 130 shown in FIGS. 1-16.

Figure 19:
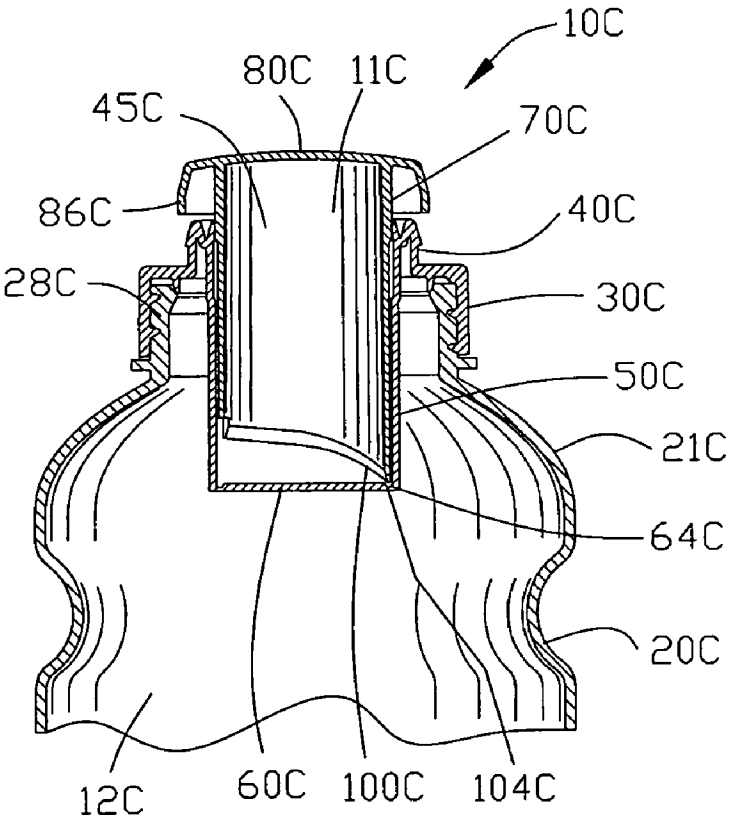
FIG. 19 is a view of the container closure of FIGS. 17 and 18 with the severable member removed from the container closure.

FIG. 19 is a view of the container closure 10C of FIGS. 17 and 18 with the severable member 110C removed from the container closure 10C. The removal of the severable member 110C enables the operator to depress the plunger 70C relative to the sleeve 50C to pierce the frangible wall 60C.

Figure 20:
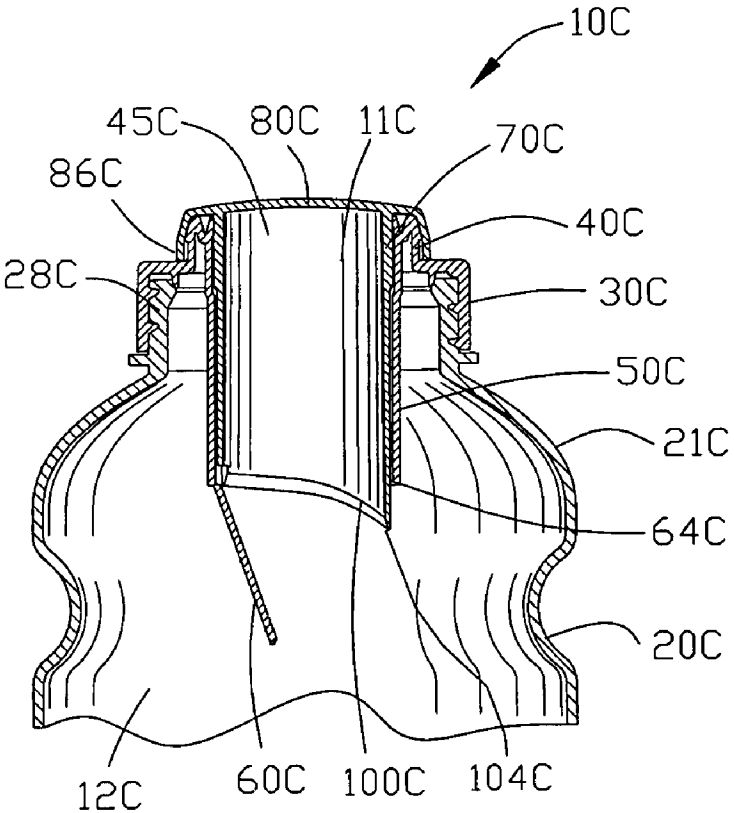
FIG. 20 is a view similar to FIG. 19 with the plunger moved into a depressed position to pierce a frangible wall.

FIG. 20 is a view similar to FIG. 19 with the plunger 70C moved into a depressed position to pierce the frangible wall 60C. The acute distal end 104C of the plunger projection 100C pierces the frangible wall 60C upon depression of the plunger 70C by the operator. The fracture of the frangible wall 60C permits the additive material 11C to enter the container 20C to mix with the container material 12C.

Figure 21:
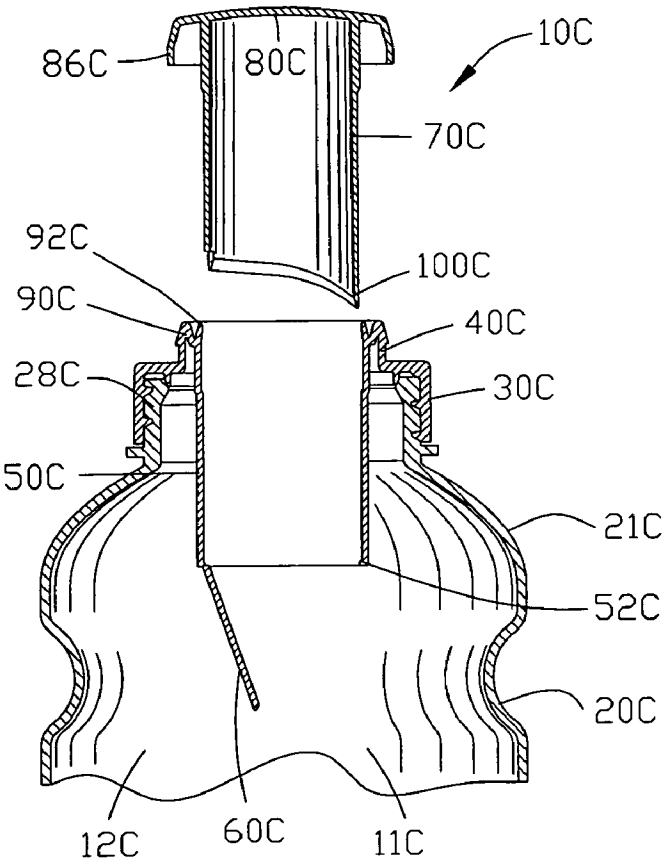
FIG. 21 is a view similar to FIG. 20 with the plunger removed from the container closure.

FIG. 21 is a view similar to FIG. 20 with the plunger 70C removed from the container closure 10C. The lack of the plunger lock 130 shown in FIGS. 1-16 in the depending skirt 86C of the plunger 70C enables the plunger 70C to be removed from the sleeve 50C of container closure 10C.

Figure 22:
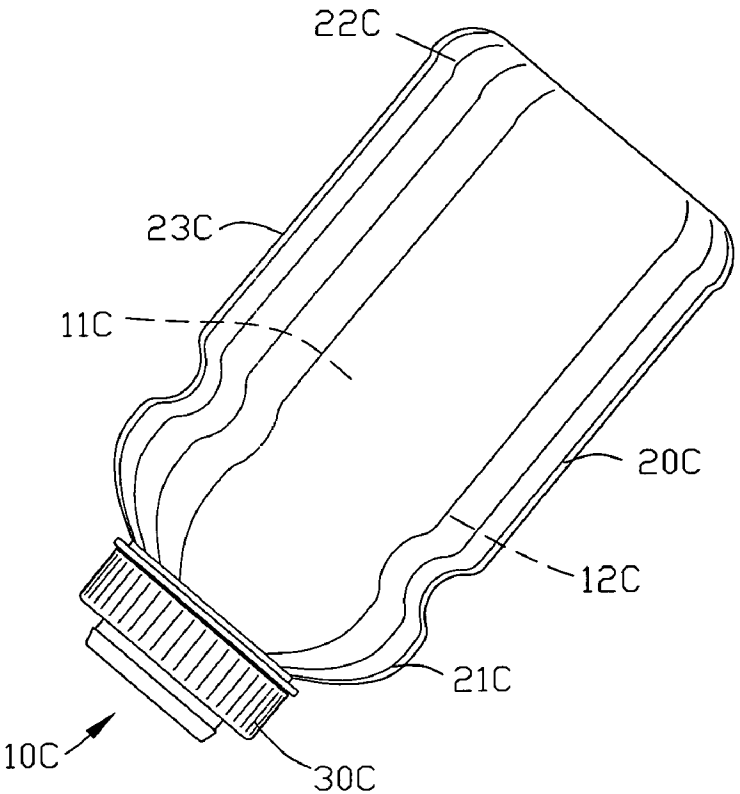
FIG. 22 is a view similar to FIG. 21 illustrating the dispensing of a mixture of the container material and the additive material.

FIG. 22 is a view similar to FIG. 21 illustrating the dispensing of the mixture of the container material 12C and the additive material 11C. The removal of the plunger 70C enables the mixture of the container material 12C and the additive material 11C to be dispensed through the sleeve 50C. After a partial dispensing of the mixture of the container material 12C and the additive material 11C, the plunger 70C may be reinserted into the sleeve 50C. When the plunger 70C is reinserted into the sleeve 50C, the expanded portion 78C of the plunger 70C compresses the distal end 92C of the resilient chevron seal 90C to reestablish the seal between the sleeve 50C and the plunger 70C.

The container closure 10 of the present invention may be used for a wide variety of additive materials 11 and container materials 12. For example, the container closure 10 of the present invention may be used for personal care use, house and garden use, industrial and medical use. The container closure 10 of the present invention may be used for a wide variety of applications such as concentrates, flavoring, fortifiers and carbonation for beverages. The container closure 10 of the present invention may be used for the addition of concentrates and fortifiers, catalyst, lubricants, driers, toners colorant and fragrance in a variety of products as well as the addition of cleaners, sanitizers, waxes and insecticides Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A container closure for retaining an additive material to mix with a container material within a container, comprising:

a base for sealing with an opening in the container;

a first and a second lock;

a reservoir comprising a sleeve and a plunger for retaining the additive material;

said sleeve being formed with said base and extending between a first end and a second end as a one-piece unit;

a resilient seal located in proximity to said first end of said sleeve;

said resilient seal comprising a resilient chevron seal extending between a proximal end and a distal end with said proximal end of said chevron seal being integrally formed with said sleeve;

said resilient chevron seal tapering from said proximal end to said distal end for increasing the resiliency of said resilient seal;

a frangible wall located in proximity to said second end of said sleeve;

said plunger extending between a first end and a second end;

an end wall located in proximity to said first end of said plunger;

a projection located on said second end of said plunger;

said plunger slidably received within said sleeve with said resilient seal interacting between said sleeve and said plunger;

a severable member integrally formed with said plunger for coacting between said base and said plunger to locate said plunger in an extended position for spacing said projection from said frangible wall and for inhibiting depression of said plunger;

said first lock preventing removal of said plunger from said extended position;

said severable member being removable for enabling said plunger to be slid into a depressed position to fracture said frangible wall with said projection to permit the additive material to enter the container; and said second lock preventing removal of said plunger from said depressed position.

2. A container closure for retaining an additive material to mix with a container material within a container, comprising:

a base for sealing with an opening in the container;

a support wall extending from said base defining a first and a second lock;

a reservoir comprising a sleeve and a plunger for retaining the additive material;

said sleeve being formed with said base and extending between a first end and a second end as a one-piece unit;

a resilient seal located in proximity to said first end of said sleeve;

said resilient seal comprising a resilient chevron seal extending between a proximal end and a distal end with said proximal end of said chevron seal being integrally formed with said sleeve;

said resilient chevron seal tapering from said proximal end to said distal end for increasing the resiliency of said resilient seal;

a frangible wall located in proximity to said second end of said sleeve;

said plunger extending between a first end and a second end;

an end wall located in proximity to said first end of said plunger;

a projection located on said second end of said plunger;

a plunger lock integrally extending from said plunger;

said plunger slidably received within said sleeve with said resilient seal interacting between said sleeve and said plunger;

a severable member integrally formed with said plunger for coacting between said base and said plunger to locate said plunger in an extended position for spacing said projection from said frangible wall and for inhibiting depression of said plunger;

a severable member lock integrally formed and extending from said severable member;

said severable member lock and said plunger lock engaging with said first and second locks, respectively for preventing removal of said plunger from said extended position;

said severable member being removable for enabling said plunger to be slid into a depressed position to fracture said frangible wall with said projection to permit the additive material to enter the container; and said plunger lock engaging with said second lock for preventing removal of said plunger from said depressed position.

3. A container closure for retaining an additive material to mix with a container material within a container, comprising:

a base for sealing with an opening in the container;

a sleeve extending between a first end and a second end;

said sleeve being secured to said base;

a frangible wall located in proximity to said second end of said sleeve;

a plunger extending between a first end and a second end;

a plunger end wall located in proximity to said first end of said plunger;

a depending skirt extending from said plunger end wall;

said plunger slidably received within said sleeve with a resilient seal interacting between said sleeve and said plunger;

a reservoir defined by said sleeve and said frangible wall and said plunger and said resilient seal for retaining the additive material;

a severable member integrally formed with said depending member of said plunger by a breakable coupling;

said severable member coacting between said base and said plunger to locate said plunger in an extended position for spacing said projection from said frangible wall and for inhibiting depression of said plunger;

a first lock comprising a plunger lock located on said depending skirt and a severable member lock located on said severable member act in unison for preventing removal of said plunger from said extended position;

said severable member including said severable member lock being removable for enabling said plunger to be telescopically plunged within said sleeve into a depressed position to fracture said frangible wall to permit the additive material to enter the container; and a second lock including said plunger lock located on said depending skirt preventing removal of said plunger from said depressed position.

4. A container closure for retaining an additive material to mix with a container material within a container, comprising:

a base for sealing with an opening in the container;

a sleeve extending between a first end and a second end;

said sleeve being secured to said base;

a frangible wall located in proximity to said second end of said sleeve;

a plunger extending between a first end and a second end;

a plunger end wall located in proximity to said first end of said plunger;

said plunger slidably received within said sleeve with a resilient seal interacting between said sleeve and said plunger;

a reservoir defined by said sleeve and said frangible wall and said plunger and said resilient seal for retaining the additive material;

a severable member integrally formed with said plunger coacting between said plunger and said base to locate said plunger in an extended position for spacing said projection from said frangible wall and for inhibiting depression of said plunger;

a first and a second lock;

said first lock and said second lock jointly preventing removal of said plunger from said extended position;

said severable member being removable for enabling said plunger to be telescopically plunged within said sleeve into a depressed position to fracture said frangible wall to permit the additive material to enter the container; and said second lock preventing removal of said plunger from said depressed position.

5. A container closure for retaining an additive material to mix with a container material within a container, comprising:

a base for sealing with an opening in the container;

a sleeve defining an inner sidewall extending between a first end and a second end of said sleeve;

said sleeve being secured to said base;

a frangible wall located in proximity to said second end of said sleeve;

a plunger extending between a first end and a second end;

a plunger end wall located in proximity to said first end of said plunger;

a depending skirt extending from said plunger end wall;

said plunger slidably received within said sleeve with a resilient seal interacting between said sleeve and said plunger;

a reservoir defined by said sleeve and said frangible wall and said plunger and said resilient seal for retaining the additive material;

a severable member integrally formed with depending skirt of said plunger by a breakable coupling for coacting between said base and said plunger to locate said plunger in an extended position for spacing said projection from said frangible wall and for inhibiting depression of said plunger;

a first lock comprising a plunger lock located on said depending skirt and a severable member lock located on said severable member act in unison for preventing removal of said plunger from said extended position;

said severable member including said severable member lock being removable for enabling said plunger to be telescopically plunged within said sleeve into a depressed position to fracture said frangible wall to permit the additive material to enter the container to mix with the container material; and said plunger being telescopically removable from said sleeve for enabling the additive material and the container material to be dispensed from the container through said inner sidewall of said sleeve.

* * * * *